US007767042B2

(12) United States Patent
Hasegawa et al.

(10) Patent No.: US 7,767,042 B2
(45) Date of Patent: Aug. 3, 2010

(54) ALUMINUM ALLOY EXTRUDED PRODUCT FOR HEAT EXCHANGERS AND METHOD OF MANUFACTURING THE SAME

(75) Inventors: Yoshiharu Hasegawa, Obu (JP); Tomohiko Nakamura, Obu (JP); Masaaki Kawakubo, Obu (JP); Naoki Yamashita, Nagoya (JP); Tatsuya Hikida, Nagoya (JP)

(73) Assignees: Denso Corporation, Kariya, Aichi (JP); Sumitomo Light Metal Industries, Ltd., Tokyo (JP)

( * ) Notice: Subject to any disclaimer, the term of this patent is extended or adjusted under 35 U.S.C. 154(b) by 541 days.

(21) Appl. No.: 11/054,334

(22) Filed: Feb. 9, 2005

(65) Prior Publication Data

US 2005/0189047 A1 Sep. 1, 2005

(30) Foreign Application Priority Data

Feb. 13, 2004 (JP) ..... 2004-036443
Feb. 7, 2005 (JP) ..... 2005-029977

(51) Int. Cl.
*C22C 21/00* (2006.01)

(52) U.S. Cl. ..... 148/437; 420/548; 420/553

(58) Field of Classification Search ..... 148/437, 148/689, 691, 550, 692; 420/548, 553
See application file for complete search history.

(56) References Cited

U.S. PATENT DOCUMENTS

| | | | | |
|---|---|---|---|---|
| 5,976,278 | A * | 11/1999 | Sircar | 148/550 |
| 6,896,749 | B2 * | 5/2005 | Morere et al. | 148/437 |
| 6,962,632 | B2 * | 11/2005 | Taguchi et al. | 148/689 |
| 2001/0028960 | A1 * | 10/2001 | Gray et al. | 428/654 |
| 2004/0131495 | A1 * | 7/2004 | Hasegawa et al. | 420/551 |

FOREIGN PATENT DOCUMENTS

JP 2002180171 A * 6/2002

* cited by examiner

*Primary Examiner*—Roy King
*Assistant Examiner*—Janelle Morillo
(74) *Attorney, Agent, or Firm*—Flynn, Thiel, Boutell & Tanis, P.C.

(57) ABSTRACT

A high-strength aluminum alloy extruded product for heat exchangers which excels in extrudability, allows a thin flat multi-cavity tube to be extruded at a high critical extrusion rate, and excels in intergranular corrosion resistance at a high temperature, and a method of manufacturing the same. The aluminum alloy extruded product includes an aluminum alloy including 0.2 to 1.8% of Mn and 0.1 to 1.2% of Si, having a ratio of Mn content to Si content (Mn %/Si %) of 0.7 to 2.5, and having a content of Cu as an impurity of 0.05% or less, with the balance being Al and impurities, the aluminum alloy extruded product having an electric conductivity of 50% IACS or more and an average particle size of intermetallic compounds precipitating in a matrix of 1 μm or less.

7 Claims, 1 Drawing Sheet

ALUMINUM ALLOY EXTRUDED PRODUCT FOR HEAT EXCHANGERS AND METHOD OF MANUFACTURING THE SAME

BACKGROUND OF THE INVENTION

1. Field of the Invention

The present invention relates to an aluminum alloy extruded product for beat exchangers and a method of manufacturing the same.

2. Description of Background Art

In automotive aluminum alloy heat exchangers such as evaporators and condensers, an aluminum alloy extruded flat multi-cavity tube including a plurality of hollow sections partitioned by a plurality of partitions has been used as a working fluid passage material.

In recent years, the weight of a beat exchanger provided in an automobile has been reduced in order to reduce the weight of the automobile, taking global environmental problems into consideration. Therefore, a further reduction in the thickness of the aluminum alloy material for heat exchangers has been demanded. In the case of the aluminum alloy flat multi-cavity tube used as the working fluid passage material, since the cross-sectional area is reduced accompanying a reduction in the thickness, the extrusion ratio (cross-sectional area of extrusion container/cross-sectional area of extruded product) is increased to several hundred to several thousand during the manufacture. Therefore, a material having a further improved extrudability has been demanded.

A fluorine-containing compound (fluorocarbon (flon)) has been used as the refrigerant for heat exchangers. However, use of carton dioxide as an alternative refrigerant has been studied in order to deal with global warming. In the case of using carbon dioxide as the refrigerant, since the working pressure is increased in comparison with a conventional fluorocarbon refrigerant, it is necessary to increase the strength of each member of the heat exchanger. Therefore, a material exhibiting high strength after assembling and brazing the heat exchange has been demanded as the working fluid passage material.

Addition of an alloy element such as Si, Fe, Cu, Mn, or Mg is effective to obtain a high-strength aluminum alloy material. However, if Mg is included in the material, when performing inert gas atmosphere brazing using a fluoride-type flux, which is mainly used as the brazing method when assembling an aluminum alloy heat exchanger, Mg in the material reacts with the fluoride-type flux to reduce the degree of activity of the flux, whereby the brazeability is decreased. If Cu is included in the material, since the operating temperature of the carbon dioxide refrigerant cycle is as high as about 150° C., the intergranular corrosion sensitivity is increased.

Therefore, attempts have been made to improve the strength by adding Si, Fe, or Mn to a pure Al material. However, when Mn and Si are added at a high concentration, Mn and Si dissolved in the aluminum matrix increase the deformation resistance, whereby the extrudability is significantly decreased in comparison with a pure Al material when the extrusion ratio reaches several hundred to several thousand as in the case of the extruded flat multi-cavity tube. Extrudability is evaluated by using, as indices, the ram pressure required for extrusion and the maximum extrusion rate (critical extrusion rate) at which the flat multi-cavity tube can be extruded without causing a deficiency at the partition of the hollow section of the flat multi-cavity tube. When Mn and Si are added at a high concentration, the ram pressure is increased in comparison with a pure Al material, whereby the die easily breaks or wears. Moreover, since the critical extrusion rate is decreased, productivity becomes poor.

A method of improving extrudability of an Al—Mn alloy for a photosensitive drum used for a copying machine or the like by reducing the deformation resistance by making the distribution of Mn uniform and causing Mn to coarsely precipitate to reduce the amount of dissolved Mn by performing two stages of homogenization treatment has been proposed (see Japanese Patent Application Laid-open No. 10-72651). However, even if this material is applied as the fluid passage material for automotive heat exchangers, since Mn is caused to coarsely precipitate, the precipitated Mn is redissolved to only a small extent. Therefore, an increase in the strength of the fluid passage material due to redissolution of Mn after assembly and brazing cannot be expected.

In the case of manufacturing a piping aluminum alloy tube for automotive heat exchangers such as automotive air conditioners by a porthole extrusion method using an Al—Mn alloy, Mn-containing compounds precipitate to a larger extent in the end section of the head section of a billet during extrusion of one billet. When continuously forming a joint by attaching the subsequent billet to the preceding billet, the and section of the preceding billet in which the Mn-containing compounds precipitate to a larger extent forms a deposition section at the joint, and the head section of the subsequent billet in which the Mn-containing compounds precipitate to a smaller extent forms a section other than the deposition section. This causes the difference in the precipitation state of the Mn-containing compounds between the deposition section and the section other than the deposition section, whereby the deposition section at a lower potential is preferentially corroded under a corrosive environment. To deal with this problem, a method of preventing the deposition section from being preferentially corroded by causing Mn-containing compounds to coarsely precipitate in the ingot matrix by subjecting an Al—Mn alloy having a specific composition to two stages of homogenization treatment to rescue the difference in the amount of dissolved Mn between the bead section and the end section of the extruded billet to eliminate the difference in the precipitation state of the Mn-containing compounds between the deposition section and the section other than the deposition section has been proposed (see Japanese Patent Application Laid-open No, 11-172388). However, since this method also causes Mn to coarsely precipitate, the precipitated Mn is redissolved to only a small extent. Therefor % an increase in the strength of the fluid passage material due to redissolution of Mn after assembly and brazing cannot be expected.

As a method of manufacturing an aluminum alloy extruded product for automotive heat exchangers, a method of applying an aluminum alloy which contains 0.3 to 1.2% of Mn and 0.1 to 1.1% of Si, has a ratio of Mn content to Si content (Mn %/Si %) of 1.1 to 4.5, and optionally contains 0.1 to 0.6% of Cu, with the balance being Al and unavoidable impurities, and homogenizing the ingot in two stages consisting of heating at 530 to 600° C. for 3 to 15 hours and heating at 450 to 550° C. for 0.1 to 2 hours in order to improve extrudability has been proposed (see Japanese Patent Application Laid-open No. 11-335764). It is confirmed that the extrudability is improved to some extent by using this method. However, since the extrudability is not necessarily sufficient when extruding a thin flat multi-cavity tube as shown in FIG. 1, room for further improvement still remains in order to reliably obtain a high critical extrusion rate.

SUMMARY OF THE INVENTION

The above-mentioned methods aim at decreasing the deformation resistance by reducing the amount of solute elements dissolved in the matrix by performing a high-temperature homogenization treatment and a low-temperature homogenization treatment. The present inventors have conducted tests and studies based on the above-mentioned methods in order to further improve extrudability. As a result, the present inventors have found that the amount of solute elements dissolved in the matrix is decreased by performing a low-temperature homogenization treatment for a long period of time due to the progress of the precipitation of the solute elements and that an improved critical extrusion rate can be reliably obtained by determining the limit of a decrease in the amount of solute elements in the matrix by the electric conductivity of an ingot and extruding an ingot having an electric conductivity of a specific value or more.

The present invention has been achieved a result of additional tests and studies on the relationship between the alloy composition and the ingot homogenization treatment condition based on the above findings in order to obtain an aluminum alloy extruded product which exhibits improved extrudability and has strength, intergranular corrosion resistance, and brazeability sufficient for a working fluid passage material for automotive heat exchangers. An objective of the present invention is to provide a high-strength aluminum alloy extruded product for heat exchanges which excels in extrudability, allows a thin flat multi-cavity tube to be extruded at a high critical extrusion rate, and excels in intergranular corrosion resistance at a high temperature, and a method of manufacturing the same.

In order to achieve the above objective, an aluminum alloy extruded product for heat exchangers according to the present invention comprises an aluminum alloy comprising 0.2 to 1.8% (mass %; hereinafter the same) of Mn and 0.1 to 1.2% of Si, having a ratio of Mn content to Si content (Mn %/Si %) of 0.7 to 2.5, and having a content of Cu as an impurity of 0.05% or less, with the balance being Al and impurities, the aluminum alloy extruded product having an electric conductivity of 50% IACS or more and an average particle size of intermetallic compounds precipitating in a matrix of 1 μm or less.

In this aluminum alloy extruded product for heat exchangers, the aluminum alloy may further comprise 0.4% or less (excluding 0%; hereinafter the same) of Mg.

In this aluminum alloy extruded product for heat exchangers, the aluminum alloy may further comprise 1.2% or less of Fe.

In this aluminum alloy extruded product for heat exchangers, the aluminum alloy may further comprise 0.06 to 0.30% of Ti.

In this aluminum alloy extruded product for heat exchangers, the aluminum alloy has an Si content of 0.4 to 1.2% and a total content of Mn and Si of 1.2% or more.

The aluminum alloy extruded product for heat exchangers my have a tensile strength of 110 MPa or more after beg subjected to heating at a temperature of 600° C. for three minutes and cooling at an average cooling rate of 150° C./min.

A method of manufacturing the above aluminum alloy extruded product comprises: subjecting an ingot of an aluminum alloy having the above composition to a first-stage homogenization on treatment which includes heating the ingot at a temperature of 550 to 650° C. for two hours or more and a second-stage homogenization treatment which includes heating the ingot at a temperature of 400 to 500° C. for three hours or more to adjust the electric conductivity of the ingot to 50% IACS or more and the average particle size of the intermetallic compounds precipitating in the matrix to 1 μm or less; and hot-extruding the resulting ingot.

According to the present invention, a high-strength aluminum alloy extruded product for heat exchangers which excels in extrudability, allows a thin flat multi-cavity tube to be extruded at a high critical extrusion rate, and excels in intergranular corrosion resistance at a high temperature, and a method of manufacturing the same can be provided.

Other objects, features, and advantages of the invention will hereinafter become more readily apparent from the following description.

DESCRIPTION OF PREFERRED EMBODIMENT

Figure 1:
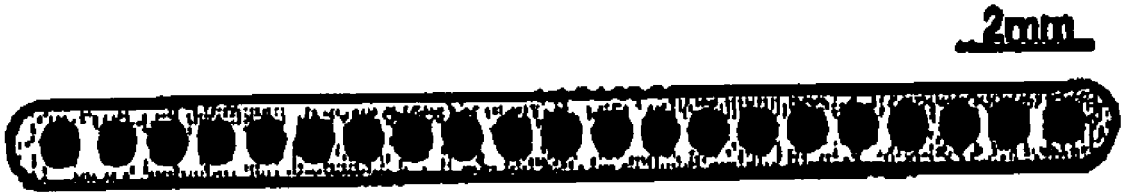
FIG. 1 is a cross-sectional view of an aluminum alloy extruded flat multi-cavity tube as an example of an extruded product according to the present invention.

The meanings and the reasons for limitation of the alloy components of the aluminum alloy of the present invention are described below. Mn is dissolved in the max during heating for brazing in a heat exchanger assembly step to improve the strength. The Mn content is preferably 0.2 to 1.8%. If the Mn content is less than 0.2%, the effect is insufficient. If the Mn content exceeds 1.8%, a decade in extrudability becomes significant rather than the strength improvement effect. The Mn content is still more preferably 0.8 to 1.8%.

Si is dissolved in the matrix during hearing for brazing in the heat exchanger assembly step to improve the strength. The Si content is preferably 0.1 to 1.2%. If the Si content is leas than 0.1%, the effect is insufficient. If the Si content exceeds 1.2%, a decrease in extrudability becomes significant rather than the strength improvement effect. The Si content is still more preferably 0.4 to 1.2%. Further excellent extrudability and strength properties can be obtained by adjusting the Si content to 0.4 to 1.2% and adjusting the total content of Mn and Si to 1.2% or more.

Extrudability is further improved by adjusting the ratio of Mn content to Si content (Mn %/Si %) to 0.7 to 2.5 within the above Mn and Si content range.

Cu is dissolved during brazing to improve the strength. The Cu content is limited to 0.05% or less in order to prevent the occurrence of intergranular corrosion during use as an automotive heat exchanger under a severe environment and to prevent a decrease in extrudability. If the Cu content exceeds 0.05%, since the operating temperature is as high a about 150° C. during use in a carbon dioxide refrigerant cycle, precipitation of Al—Mn compounds or the like significantly occurs at the grain boundaries, whereby intergranular corrosion tends to occur. Moreover, extrudability is decreased.

Mg contributes to an improvement of the strength without causing a problem in an inert gas atmosphere brazing using a fluoride-type flux, if the Mg content is in the range of 0.4% or less. If the Mg content exceeds 0.4%, Mg reacts with the fluoride-type flux based on potassium fluoroaluminate during brazing using the fluoride-type flux to form compounds such as $MgF_2$ and $KMgF_3$, whereby the brazeability is decreased due to a decrease in the degree of activity of the flux.

Fe increases the strength. The Fe content is preferably 1.2% or less. If the Fe content exceeds 1.2%, large amounts of Al—Fe compounds and Al—Fe—Si compounds are formed during casting, whereby the extrudability is hindered. Moreover, the Al—Fe compounds and the Al—Fe—Si compounds function as a cathode during use as an automotive heat exchanger, whereby self-corrosion resistance is decreased.

Ti forms a high-concentration region and a low-concentration region in the alloy. These regions are alternately distributed in layers in the thickness direction of the material. Since the low-concentration region is preferentially corroded in comparison with the high-concentration region, the corrosion form becomes layered. This prevents the progress of corrosion in the thickness direction, whereby the pitting corrosion resistance and intergranular corrosion resistance are improved. The Ti content is preferably 0.06 to 0.30%. If the Ti content is less than 0.06%, the effect is insufficient. If the Ti content exceeds 0.30%, the extrudability is impaired due to the formation of coarse compounds during casting, whereby a sound extruded product cannot be obtained. The Ti content is still more preferably 0.10 to 0.25%. The effect of the present invention is not affected even if less than 0.06% of Ti and 0.1% or less of B are included in the aluminum alloy extruded product of the present invention. The total content of the impurities such as Cr, Zn, and Zr can be 0.25% or less.

The aluminum alloy extruded product of the present invention may be obtained by dissolving an aluminum alloy having the above-described composition, casting the dissolved aluminum alloy by so continuous casting or the link, subjecting the resulting ingot (extrusion billet) to a first-stage homogenization treatment at a temperature of 550 to 650° C. for two hours or more and a second-stage homogenization treatment at a temperature of 400 to 500° C., for three hours or more to adjust the electric conductivity of the ingot to 50% IACS or more, and hot-extruding the resulting ingot.

In the first-stage homogenization treatment, a coarse crystallized product formed during casting and solidification is decomposed, granulated, or redissolved. If the treatment temperature is less than 550° C. the effect is insufficient. The effect is increased as the treatment tempera is increased. However, if the treatment temperature exceeds 650° C. the ingot may melt. The first-strap homogenization treatment temperature is preferably 580 to 620° C. Since the reaction progresses as the treatment time is increased, the treatment time is preferably set to 10 hours or more. However, since the effect is developed to a maximum when the treatment time exceeds 24 hours, a further effect cannot be expected even if the treatment is performed for more than 24 hours. Therefore, such a long treatment is disadvantageous from the economical point of view. The treatment time is still more preferably 10 to 24 hours.

In the first-stage homogenization treatment, a coarse crystallized product formed during casting and solidification is decomposed, granulated, or redissolved as described above. The first-stage homogenization treatment also promotes dissolving of the solute elements Mn and Si in the matrix. However, if the amount of solute elements dissolved in the matrix is increased, the motion speed of the dislocation in the matrix is decreased, whereby the deformation resistance is increased. Therefore, if the ingot is hot-extruded after subjecting the ingot only to the high-temperature first-stage homogenization treatment, the extrudability is decreased.

Mn and Si dissolved in the matrix precipitate by performing the low-temperature second-stage homogenization treatment after the high-temperature first-stage homogenization treatment, whereby the amount of solute Mn and Si dissolved in the matrix can be decreased. This enables the deformation resistance to be decreased during the subsequent hot extrusion, whereby the extrudability can be increased. If the treatment temperature is less than 400° C., the effect is insufficient. If the treatment temperature exceeds 500° C., precipitation occurs to only a small extent, whereby the effect becomes insufficient. Since the reaction progresses as the treatment time is increased, the treatment time must be three hours or more. The treatment time is preferably five hours or more. However, since the effect is developed to a maximum when the treatment time exceeds 24 hours, a further effect cannot be expected even if the treatment is performed for more than 24 hours. Therefore, such a long treatment is disadvantageous from the economical point of view. The treatment time is still more preferably 5 to 15 hours.

The amount of the solute elements dissolved in the matrix is decreased by subjecting the ingot to the first-stage and second-stage homogenization treatments, whereby the extrudability is increased. The electric conductivity is the index for the amount of the solute elements dissolved in the matrix. The electric conductivity is decreased as the amount of the solute elements dissolved in the matrix is increased, and the electric conductivity is increased as the amount of the solute elements dissolved in the matrix is decreased due to the progress of the precipitation. As the limit of the amount of the solute elements dissolved in the matrix at which excellent extrudability is obtained, it is preferable to specify the electric conductivity of the ingot at 50% IACS or more. An electric conductivity of 50% IACS or more can be reliably obtained by adjusting the combination of the high-temperature first-stage homogenization treatment condition and the low-temperature second-stage homogenization treatment condition, in particular, by including the low-temperature homogenization treatment for a long period of time, whereby extrudability can be reliably improved.

In general, the first-stage homogenization treatment and the second-stage homogenization treatment are continuously performed. However, the first-stage homogenization treatment and the second-stage homogenization treatment may not necessarily be continuously performed. For example, the ingot (extrusion billet) may be cooled to room temperature after the first-stage homogenization treatment, and the second-stage homogenization treatment may then be performed.

In the case where the electric conductivity of the ingot is adjusted to 50% IACS or more, since the solute elements are redissolved to only a small extent during the hot extrusion, the electric conductivity of 50% IACS or more is maintained after the hot extrusion. The aluminum alloy extruded product obtained by the hot extrusion is assembled to a heat exchanger and joined by brazing. In this case, since Mn and Si which have been precipitated by the two stages of homogenization treatment are redissolved in the matrix, the electric conductivity after brazing become less than 50% IACS.

When using the carbon dioxide refrigerant cycle for an automotive heat exchanger, since the operating temperature is as high as about 150° C., creep strength is required for each member. In the present invention, since Mn and Si which have been precipitated by the two stages of homogenization treatment are redissolved in the matrix after heating for brazing, these elements hinder the motion of a dislocation in the matrix whereby the creep resistance is improved. In the present invention, it is preferable to adjust the average particle size of intermetallic compounds such as Al—Mn compounds and Al—Mn—Si compounds which have been precipitated in the matrix of the hot-extruded product to as small as 1 μm or less in order to promote redissolution.

As described above, since the solute elements are redissolved to only a small extent during the hot extrusion when the electric conductivity of the ingot is adjusted to 50% IACS or more, it suffices to adjust the average particle size of compounds which precipitate by the two stages of homogenization treatment to 1 μm or less in order to adjust the average particle size of compounds which have been precipitated in the matrix of the hot-extruded product to 1 μm or less. Precipitation on of such minute intermetallic compounds may be obtained by adjusting the combination of the first-stage homogenization treatment condition and the second-stage homogenization treatment condition and adjusting the cooling rate after the homogenization treatment.

The aluminum alloy extruded product manufactured as described above achieves high strength with a tensile strength of 110 MPa or more after treatment equivalent to heating for brazing consists of heating at a temperature of 600° C. for three minutes and cooling at an average cooling rate of 150° C./min.

EXAMPLES

Example 1

The present invention is described below by comparison between examples and comparative examples. However, the following examples merely demonstrate one embodiment of the present invention, and the present invention is not limited to the following examples.

An aluminum alloy having a composition shown in Table 1 was cast into an extrusion billet. The resulting billet was subjected to a first-stage homogenization treatment and a second-stage homogenization treatment under conditions shown in Table 2, and hot-extruded into a flat multi-cavity tube having a cross-sectional shape as shown in FIG. 1. The resulting extruded product was used as a specimen, and subjected to evaluation of the critical extrusion rate, tensile strength, brazeability, and intergranular corrosion sensitivity according to the following methods. Table 3 shows the electric conductivity after the homogenization treatment, electric conductivity after extrusion, electric conductivity after brazing, average particle size (equivalent circular average diameter) of intermetallic compounds after the homogenization treatment, and average particle size of intermetallic compounds after extrusion. Table 4 shows the evaluation results for brazeability, critical extrusion rate, tensile strength, and intergranular corrosion sensitivity. In Tables 1 to 3, values outside of the conditions of the present invention are underlined.

The critical extrusion rate was evaluated as a ratio to the critical extrusion rate (165 m/min) of a conventional alloy (specimen No. 15, alloy L) in which Mn and Cu were added to pure aluminum in small amounts (critical extrusion rate of the conventional alloy was 1.0). A specimen with a critical extrusion rate of 0.9 to 1.0 was evaluated as "Excellent", a specimen with a critical extrusion rate of 0.8 or more, but less than 0.9 was evaluated as "Good", a specimen with a critical extrusion rate of 0.7 or more, but less than 0.8 was evaluated as "Fair", and a specimen with a critical extrusion rate of less than 0.7 was evaluated as "Bad".

Tensile Strength:

As a simulation for brazing, the specimen was subjected to a heat treatment at 600° C. for three minutes in a nitrogen atmosphere and was cooled at an average cooling rate of 150° C./min to obtain a tensile test specimen. The tensile test specimen was subjected to a tensile test.

Brazeability:

A fluoride-type flux based on potassium fluoroaluminate was applied to the surface of the specimen in an amount of 10 g/m$^2$. The specimen was assembled with a brazing fin and heated at 600° C. for three minutes, and the joinability was observed with the naked eye. A specimen in which a fillet was sound and a sufficient junction was obtained was evaluated as "Good", and a specimen in which the formation of a fillet was not sound was evaluated a "Bad".

Intergranular Corrosion Sensitivity:

After heating for brazing for the brazeability test, the specimen was heated at 150° C. for 120 hours and immersed in a solution obtained by adding 10 mg/l of HCl to 30 g/l of a NaCl aqueous solution for 24 hours as a simulation for use at 150° C. Then, a cross-sectional observation was performed to investigate the presence or absence of intergranular corrosion. A specimen in which intergranular corrosion did not occur was evaluated as "Good", and a specimen in which intergranular corrosion occurred was evaluated as "Bad".

TABLE 1

| | | Composition (mass %) | | | | | | |
|---|---|---|---|---|---|---|---|---|
| | Alloy | Si | Fe | Cu | Mn | Mg | Ti | Mn/Si |
| Invention | A | 0.6 | 0.2 | 0.00 | 1.2 | — | — | 2 |
| | B | 0.5 | 0.2 | 0.00 | 1.0 | 0.1 | — | 2 |
| | C | 0.4 | 0.2 | 0.00 | 0.3 | 0.2 | — | 0.75 |
| | D | 0.4 | 0.9 | 0.00 | 0.8 | 0.1 | — | 2 |
| | E | 0.8 | 0.9 | 0.00 | 0.8 | — | — | 1 |
| | F | 0.4 | 0.2 | 0.00 | 1.0 | 0.15 | — | 2.5 |
| | G | 0.5 | 1.0 | 0.00 | 1.0 | 0.1 | 0.15 | 2 |
| Comparison | H | 1.5 | 0.2 | 0.00 | 1.9 | — | — | 1.3 |
| | I | 0.05 | 0.2 | 0.00 | 0.1 | — | — | 2 |
| | J | 0.6 | 0.2 | 0.3 | 1.2 | — | — | 2 |
| | K | 0.6 | 0.2 | 0.00 | 1.2 | 0.6 | — | 2 |
| | L | 0.6 | 1.3 | 0.00 | 1.2 | — | — | 2 |
| | M | 0.05 | 0.2 | 0.4 | 0.1 | — | — | 2 |

TABLE 2

| | | Homogenization treatment | |
|---|---|---|---|
| Specimen | Alloy | First stage (temperature (° C.) × time (h)) | Second stage (temperature (° C.) × time (h)) |
| 1 | A | 600 × 15 | 450 × 10 |
| 2 | B | 600 × 15 | 450 × 10 |
| 3 | C | 600 × 15 | 450 × 10 |
| 4 | D | 600 × 15 | 450 × 10 |
| 5 | E | 600 × 15 | 450 × 10 |
| 6 | F | 600 × 15 | 450 × 10 |
| 7 | G | 600 × 15 | 450 × 10 |
| 8 | H | 600 × 15 | 450 × 10 |
| 9 | I | 600 × 15 | 450 × 10 |
| 10 | J | 600 × 15 | 450 × 10 |
| 11 | K | 600 × 15 | 450 × 10 |
| 12 | L | 600 × 15 | 450 × 10 |
| 13 | A | 530 × 15 | 450 × 10 |
| 14 | A | 600 × 15 | 530 × 10 |
| 15 | A | 600 × 15 | 450 × 1 |
| 16 | M | 600 × 15 | 450 × 10 |

TABLE 3

| Specimen | Alloy | Electric conductivity (% IACS) | | | Average particle size of intermetallic compounds (μm) | |
|---|---|---|---|---|---|---|
| | | After homogenization treatment | After extrusion | After brazing | After homogenization treatment | After extrusion |
| 1 | A | 54.6 | 52.5 | 46.5 | 0.42 | 0.49 |
| 2 | B | 53.9 | 51.2 | 45.9 | 0.42 | 0.49 |
| 3 | C | 50.9 | 51.6 | 49.0 | 0.41 | 0.47 |
| 4 | D | 50.7 | 50.3 | 48.4 | 0.50 | 0.55 |
| 5 | E | 54.0 | 52.4 | 49.7 | 0.50 | 0.56 |
| 6 | F | 53.8 | 51.8 | 49.8 | 0.52 | 0.58 |
| 7 | G | 53.5 | 51.0 | 44.5 | 0.55 | 0.61 |
| 8 | H | 49.1 | 47.0 | 45.8 | 0.60 | 0.65 |
| 9 | I | 53.3 | 53.0 | 52.9 | 0.41 | 0.50 |
| 10 | J | 53.1 | 49.5 | 45.2 | 0.44 | 0.51 |
| 11 | K | 46.0 | 48.8 | 45.1 | 0.44 | 0.50 |
| 12 | L | 49.7 | 49.1 | 48.1 | 0.60 | 0.66 |
| 13 | A | 47.6 | 48.8 | 46.4 | 1.05 | 1.10 |
| 14 | A | 43.8 | 46.0 | 44.3 | 1.03 | 1.05 |
| 15 | A | 44.1 | 47.5 | 45.0 | 1.11 | 1.15 |
| 16 | M | 52.0 | 51.3 | 52.0 | 0.43 | 0.49 |

TABLE 4

| Specimen | Alloy | Critical extrusion ratio | Brazeability | Tensile strength | Intergranular corrosion sensitivity |
|---|---|---|---|---|---|
| 1 | A | Excellent (1.0) | Good | 114 | Good |
| 2 | B | Excellent (0.95) | Good | 120 | Good |
| 3 | C | Good (0.85) | Good | 110 | Good |
| 4 | D | Excellent (1.0) | Good | 113 | Good |
| 5 | E | Good (0.85) | Good | 117 | Good |
| 6 | F | Excellent (0.9) | Good | 110 | Good |
| 7 | G | Excellent (0.95) | Good | 126 | Good |
| 8 | H | Bad (0.4) | Good | 145 | Good |
| 9 | I | Excellent (1.0) | Good | 68 | Good |
| 10 | J | Fair (0.7) | Good | 122 | Bad |
| 11 | K | Bad (0.6) | Bad | 168 | Good |
| 12 | L | Fair (0.75) | Good | 125 | Bad |
| 13 | A | Fair (0.75) | Good | 114 | Good |
| 14 | A | Fair (0.7) | Good | 114 | Good |
| 15 | A | Fair (0.7) | Good | 115 | Good |
| 16 | M | Excellent (1.0) | Good | 72 | Bad |

As shown in Table 4, the specimens No. 1 to No. 7 according to the condition of the present invention exhibited a high critical extrusion rate, an excellent tensile strength of 110 MPa or more after heating for brazing, excellent brazeability, and excellent intergranular corrosion resistance.

On the other hand, specimen No. 8 exhibited an inferior extrudeability due to high Si and Mn content and specimen No. 9 exhibited an inferior strength due to low Si and Mn content. Specimen No. 10 exhibited inferior intergranular corrosion resistance due to the inclusion of Cu and specimen No. 11 exhibited an inferior brazeability due to a high Mg content. Specimen No. 12 exhibited an inferior extrudability and intergranular corrosion resistance due to a high Fe content.

Specimen No. 13 exhibited an inferior extrudability due to a low first-stage homogenization treatment temperature, specimen No. 14 exhibited an inferior extrudability due to a high second-stage homogenization treatment temperature and specimen No. 15 exhibited an inferior extrudability due to a short second-stage homogenization treatment time. Specimen No. 16, which is a conventional alloy containing Cu, exhibited an inferior intergranular corrosion resistance.

Obviously, numerous modifications and variations of the present invention are possible in light of the above teachings. It is therefore to be understood flat, within the scope of the appended claims, the invention may be practiced otherwise than as specifically described herein.

What is claimed is:

1. An aluminum alloy extruded product for heat exchangers comprising an aluminum alloy consisting essentially of 0.2 to 1.8% Mn and 0.4 to 1.2% Si, with a total content of Mn and Si of at least 1.2% and ratio of Mn content to Si content of from 0.7 to 2.5, and Cu, as an impurity, of no more than 0.05%, optionally, up to 0.4% of Mg, up to 1.2% of Fe and 0.06 to 0.30% of Ti, with the balance being Al and other impurities, the element content being expressed in mass %, the aluminum alloy extruded product having an electric conductivity of at least 50% IACS and an average particle size of intermediate compounds precipitating in a matrix of no more than 1 μm, and a tensile strength of at least 110 MPa after being subjected to heating at a temperature of 600° C. for three minutes and cooling at an average cooling rate of 150° C./min.

2. The aluminum alloy extruded product of claim 1, wherein the aluminum alloy further contains Mg in an amount not exceeding 0.4%.

3. The aluminum alloy extruded product of claim 1, wherein the aluminum alloy further contains up to 1.2% of Fe.

4. The aluminum alloy extruded product of claim 1, wherein the aluminum alloy further contains 0.06 to 0.30% of Ti.

5. The aluminum alloy extruded product of claim 2, wherein the aluminum alloy further contains up to 1.2% of Fe.

6. The aluminum alloy extruded product of claim 2, wherein the aluminum alloy further contains 0.06 to 0.30% of Ti.

7. The aluminum alloy extruded product of claim 3, wherein the aluminum alloy further contains 0.06 to 0.30% of Ti.

* * * * *